US009502827B2

(12) United States Patent
Feng et al.

(10) Patent No.: US 9,502,827 B2
(45) Date of Patent: Nov. 22, 2016

(54) ELECTRICAL CONNECTOR WITH IMPROVED METAL SHELL

(71) Applicant: DONGGUAN XUNTAO ELECTRONIC CO., LTD., Dongguan,Guangdong Province (CN)

(72) Inventors: Yun Feng, Dongguan (CN); Zhong-Yuan Lai, Dongguan (CN)

(73) Assignee: DONGGUAN XUNTAO ELECTRONIC CO., LTD., Dongguan, Guangdong (CN)

( * ) Notice: Subject to any disclaimer, the term of this patent is extended or adjusted under 35 U.S.C. 154(b) by 0 days.

(21) Appl. No.: 14/556,148

(22) Filed: Nov. 29, 2014

(65) Prior Publication Data

US 2016/0104972 A1 Apr. 14, 2016

(30) Foreign Application Priority Data

Oct. 10, 2014 (CN) ..... 2014 2 0585115 U

(51) Int. Cl.

| | |
|---|---|
| ***H01R 13/648*** | (2006.01) |
| ***H01R 13/6581*** | (2011.01) |
| *H01R 13/66* | (2006.01) |
| *H01R 24/60* | (2011.01) |
| *H01R 107/00* | (2006.01) |

(52) U.S. Cl.

CPC ..... *H01R 13/6581* (2013.01); *H01R 13/665* (2013.01); *H01R 24/60* (2013.01); *H01R 2107/00* (2013.01)

(58) Field of Classification Search

CPC ..... H01R 13/65802; H01R 23/6873; H01R 13/6581; H01R 13/6593; H01R 13/506; H01R 13/514; H01R 13/6582

See application file for complete search history.

(56) References Cited

U.S. PATENT DOCUMENTS

| | | | | |
|---|---|---|---|---|
| 5,676,569 | A * | 10/1997 | Davis | H01R 13/518 439/540.1 |
| 5,975,954 | A * | 11/1999 | Wu | H01R 23/6873 439/607.35 |
| 6,645,013 | B1 * | 11/2003 | Toyota | H01R 12/7082 439/660 |
| 6,863,545 | B2 * | 3/2005 | Peloza | H01R 12/7005 439/701 |
| 7,037,135 | B2 | 5/2006 | Chen et al. | |
| 7,578,705 | B2 * | 8/2009 | He | H01R 13/514 439/660 |
| 7,922,535 | B1 * | 4/2011 | Jiang | H01R 13/5205 439/271 |
| 9,022,800 | B2 * | 5/2015 | Yang | H01R 13/6581 439/487 |
| 9,106,036 | B2 * | 8/2015 | Yang | H01R 24/60 |
| 2013/0330976 | A1 | 12/2013 | Simmel et al. | |

FOREIGN PATENT DOCUMENTS

| | | |
|---|---|---|
| TW | M484822 U | 8/2014 |
| TW | M484832 U | 8/2014 |

* cited by examiner

*Primary Examiner* — Xuong Chung Trans
(74) *Attorney, Agent, or Firm* — Cheng-Ju Chiang

(57) ABSTRACT

An electrical connector includes an insulative housing, at least one contact module, an inner metal shell, and a tubular outer metal shell. The insulative housing has a top wall, a bottom wall, a pair of side walls, and a receiving chamber. The contact module includes an insulator and a set of contacts retained in the insulator. Each contact has a contact portion protruding into the receiving chamber. The inner metal shell has a main frame surrounding the insulative housing by 360 degrees. The outer metal shell surrounds the inner metal shell and contacts with the inner metal shell.

19 Claims, 6 Drawing Sheets

ELECTRICAL CONNECTOR WITH IMPROVED METAL SHELL

BACKGROUND OF THE INVENTION

1. Field of the Invention

The present invention relates to an electrical connector, and more particularly to an electrical connector adapted for transmitting high-frequency signals.

2. Description of Related Art

An conventional electrical connector for transmitting high-frequency signals usually comprises an insulative housing, a pair of contact modules retained in the insulative housing, a metal sheet located between the two contact modules, and a metal shell surrounding the insulative housing and the two contact modules to achieve anti-EMI performance. However, the metal shell is configured as single layer structure, it is necessary to improve the electrical connector to achieve a better EMI (electro-magnetic interference) shielding performance so as to transmit high-frequency signals safely and reliably. Furthermore, the electrical connector includes so many parts including insulative housing, two contact modules, a metal sheet, a metal shell which are not assembled closely, and the structural strength of the electrical connector will be reduced easily.

Hence, an improved electrical connector for solving the above issue is desired.

BRIEF SUMMARY OF THE INVENTION

According to an aspect of the present invention, an electrical connector comprises an insulative housing defining a top wall, a bottom wall, a pair of side walls connecting the top and bottom walls, and a receiving chamber surrounded by the top wall, the bottom wall and the two side walls; at least one contact module assembled to the insulative housing, the contact module including an insulator and a plurality of contacts retained in the insulator, each contact defining a contact portion protruding into the receiving chamber; an one-piece inner metal shell defining a main frame surrounding the insulative housing by 360 degrees; and a tubular outer metal shell surrounding the inner metal shell and contacting with the inner metal shell.

According to another aspect of the present invention, an electrical connector comprises an insulative housing defining a receiving chamber recessed rearwardly from a front side thereof, an annular rib surrounding the receiving chamber at an entrance of the receiving chamber, and a plurality of openings formed on the insulative housing and connecting the receiving chamber with exterior, the openings being located at back of the annular rib; a plurality of contacts extending into the receiving chamber; an inner metal shell retained in the insulative housing, and defining a plurality of spring fingers passing through the respective openings and protruding inwardly into the receiving chamber; and an outer metal shell surrounding the insulative housing. The outer metal shell locates at back of the annular rib and contacts with the inner metal shell.

According to a third aspect of the present invention, an electrical connector comprises an insulative housing defining a top wall, a bottom wall, a pair of side walls connecting the top and bottom walls, and a receiving chamber surrounded by the top wall, the bottom wall and the two side walls and passing through a front end thereof; a pair of contact modules assembled to the insulative housing, each of the contact module including an insulator and a plurality of contacts retained in the insulator, each contact defining a contact portion protruding into the receiving chamber, each insulator comprising a front section inserted into the insulative housing, a middle section and a rear section protruding beyond the insulative housing; an inner metal shell defining a main frame surrounding both the insulative housing and the middle sections of the insulators, the rear sections protruding beyond the main frame; and a tubular outer metal shell surrounding both the inner metal shell and the rear sections of the insulators. the outer metal shell contacts with the inner metal shell.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
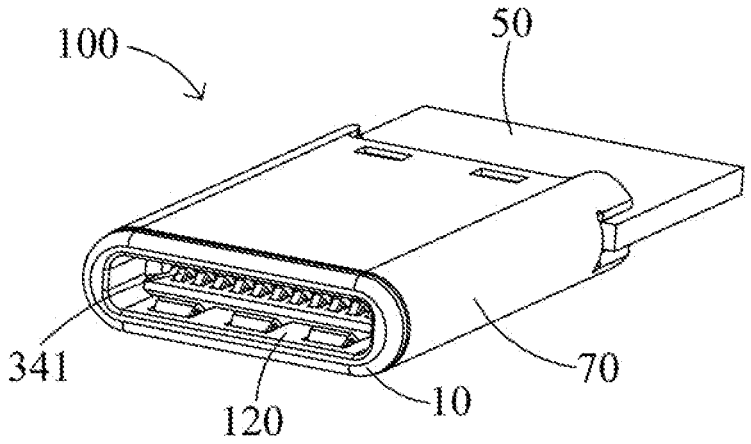
FIG. 1 is a perspective view of an electrical connector in accordance with an illustrated embodiment of the present invention.

Reference will now be made to the drawing figures to describe the embodiments of the present invention in detail. In the following description, the same drawing reference numerals are used for the same elements in different drawings.

Figure 2:
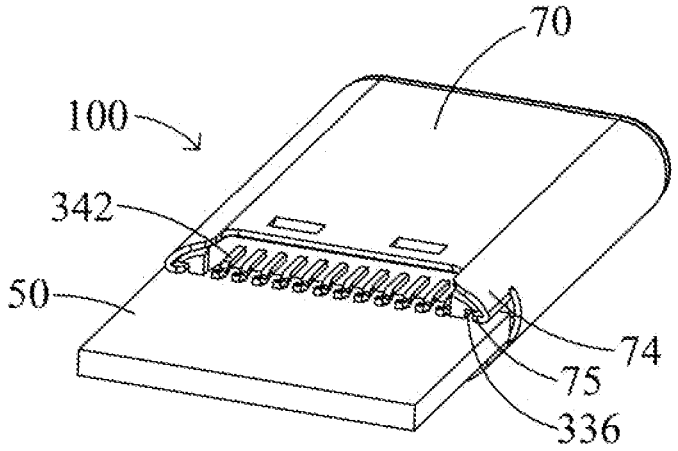
FIG. 2 is a perspective view of the electrical connector as shown in FIG. 1 while taken from a different aspect.
Figure 3:
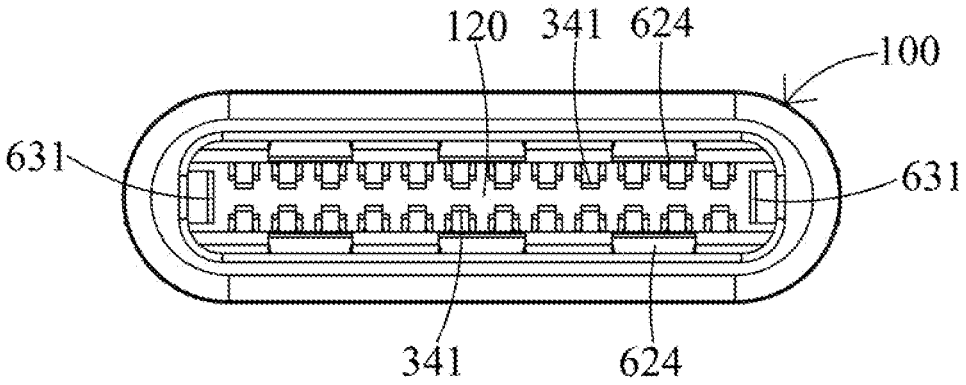
FIG. 3 is a front elevation view of the electrical connector as shown in FIG. 1.
Figure 4:
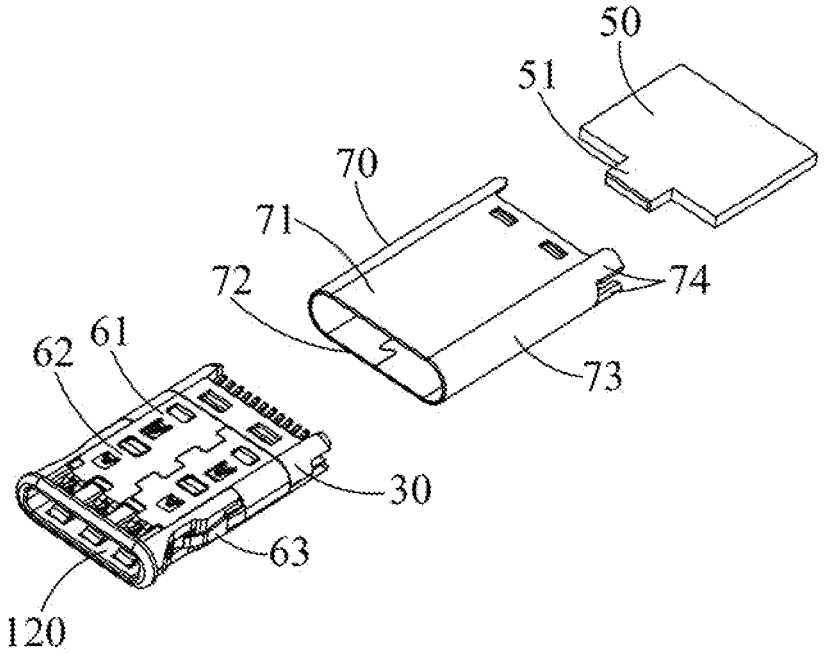
FIG. 4 is a partly exploded view of the electrical connector with an outer metal shell and an inner circuit board separated therefrom, showing relationship between an insulative housing and the inner metal shell.
Figure 5:
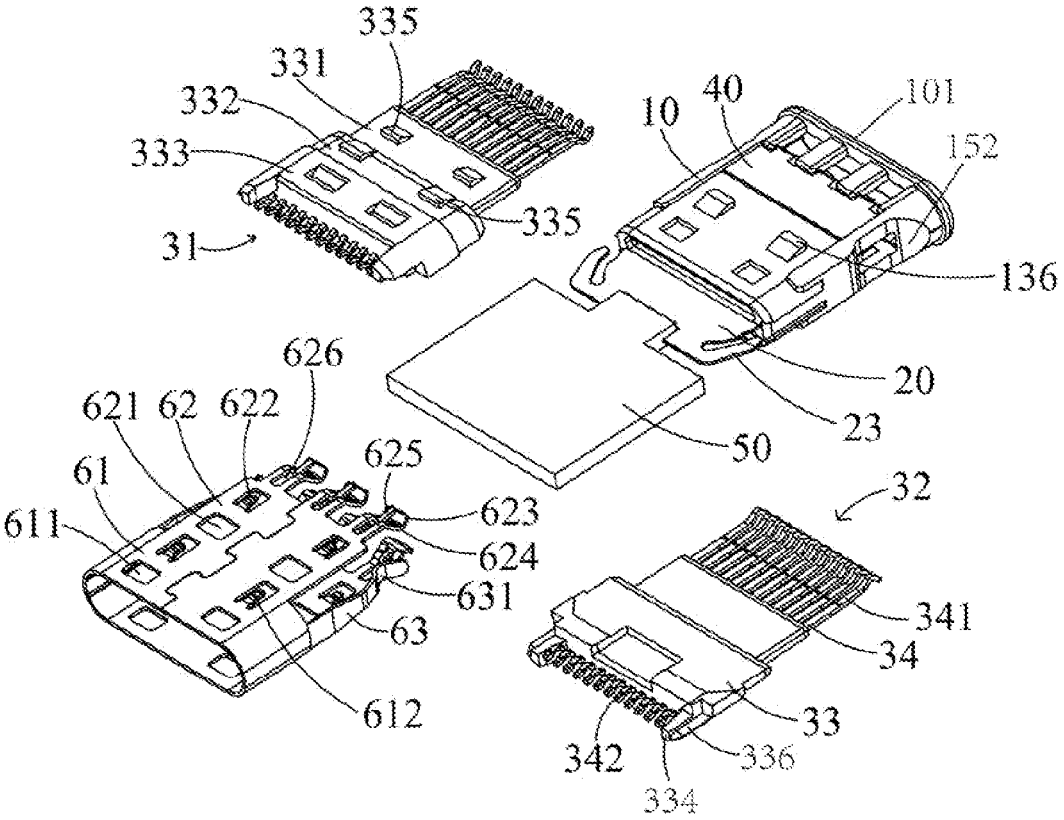
FIG. 5 is a partly exploded view of the electrical connector with the outer metal shell and contact modules separated therefrom, showing relationship between the inner circuit board and an inner metal sheet.
Figure 6:
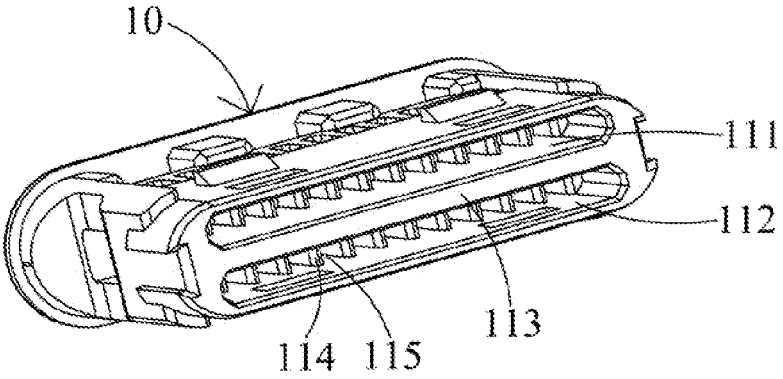
FIG. 6 is a perspective view of the insulative housing of the electrical connector.
Figure 7:
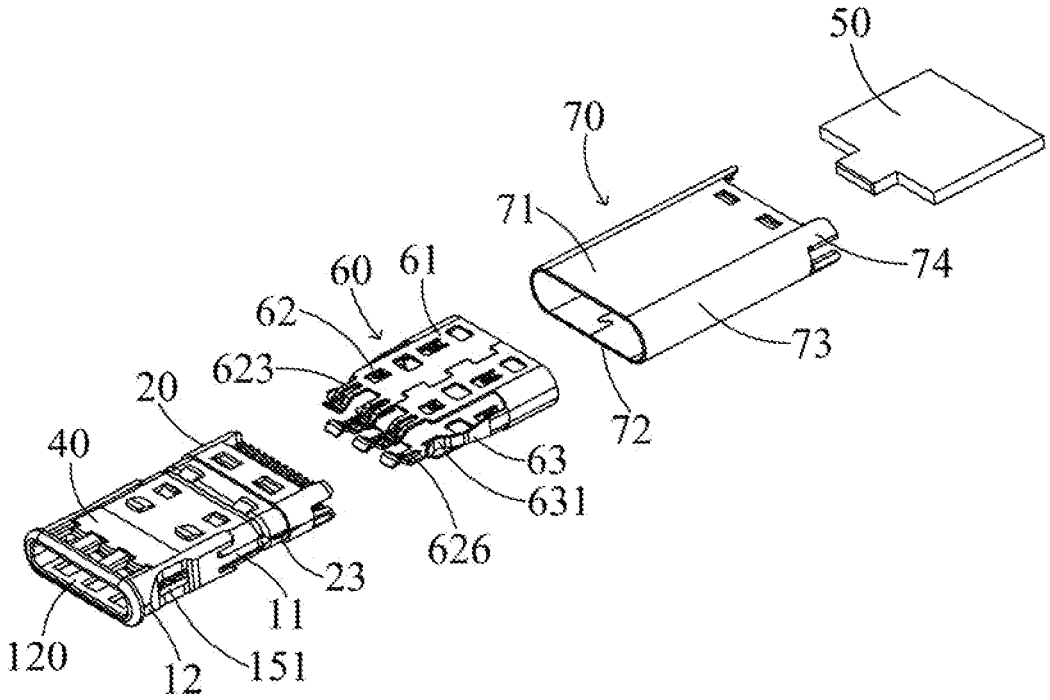
FIG. 7 is a partly exploded view of the electrical connector with the inner metal shell, the outer metal shell and the inner circuit board separated therefrom, showing relationship between the insulative housing and the contact modules.
Figure 8:
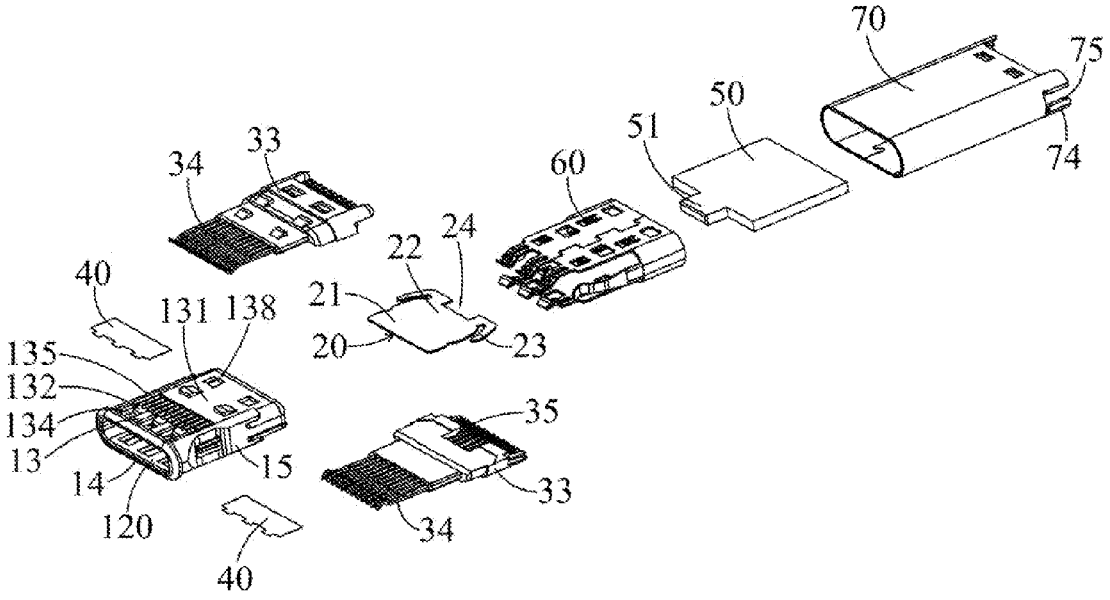
FIG. 8 is an exploded view of the electrical connector as shown in FIG. 1.
Figure 9:
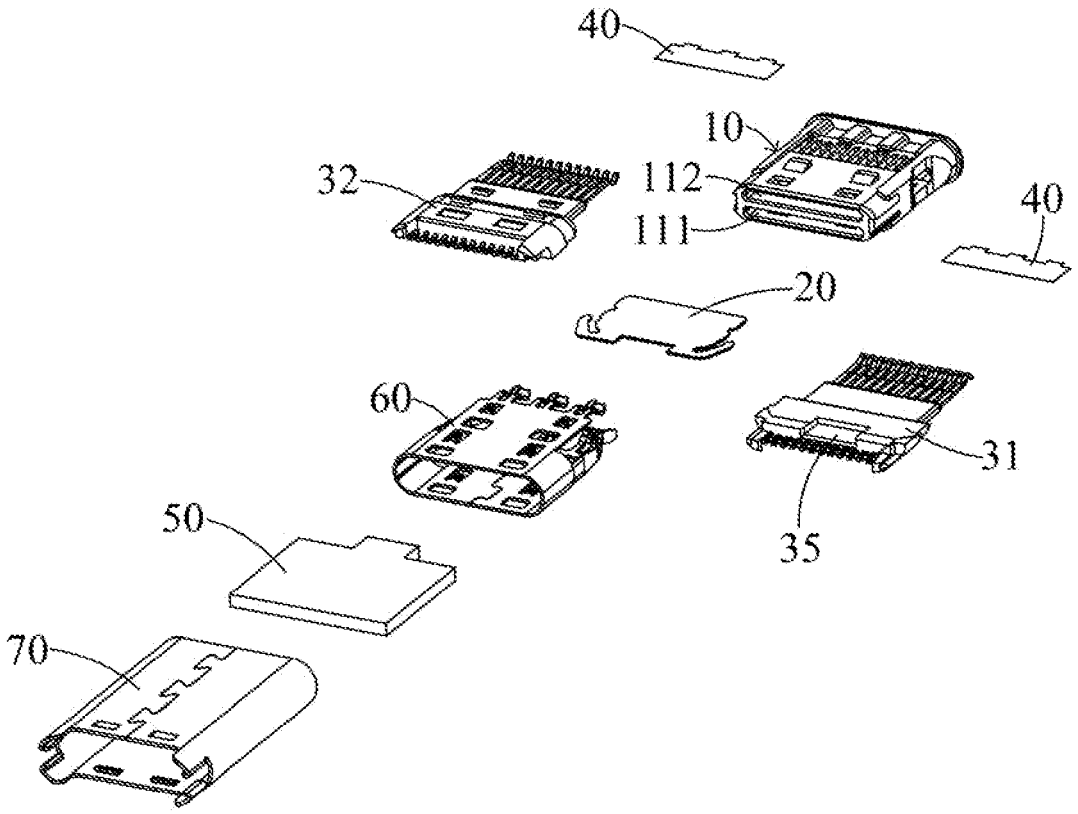
FIG. 9 is an exploded view of the electrical connector as shown in FIG. 8 while taken from a different aspect.

Referring to FIGS. 1 to 9, the present invention discloses an electrical connector 100 adapted for transmitting high-frequency signals. According to the illustrated embodiment of the present invention, the electrical connector 100 is an USB Type-C plug connector adapted to mate with a corresponding USB Type-C receptacle connector. The electrical connector 100 includes an insulative housing 10, a metal sheet 20, a pair of contact modules 30, a pair of mylar foils 40, an inner circuit board 50 for connecting with the cables, an inner metal shell 60 surrounding all sides of the insulative housing 10 and the contact modules 30, an outer metal shell 70 surrounding the inner metal shell 60 and the contact modules 30. The contact modules 20 are forwardly assembled into the insulative housing 10 and sandwich the inner circuit board 50 therebetween.

Referring to FIGS. 5-9, the insulative housing 10 includes a base portion 11 and a mating portion 12 protruding forwardly from the base portion 11. The insulative housing 10 includes a pair of top and bottom walls 13, 14, and a pair of side walls 15 connecting the top and bottom walls 13, 14. A receiving chamber 120 is formed among the top wall 13, the bottom wall 14 and two side walls 15 at the mating portion 12 and passes through a front face of the insulative housing 10 for receiving a tongue of a complementary connector (not shown). The insulative housing 10 has a first recess portion and a second recess portion 131, 132 formed at each of the top and bottom walls 13, 14, and an annular rib 101 formed at front of the first recess portions 131 and surrounding a front side of the receiving chamber 120. The second recess portion 132 recesses downwardly from the respective first recess portion 131.

Each of the top and bottom walls 13, 14 defines a set of openings 134 and a number of contact grooves 135 both passing therethrough and communicating with the receiving chamber 12. The openings 134 of each of the top and bottom walls 13, 14 are arranged in one row along a transverse direction and communicate with the first recess portion 131. The contact grooves 135 of each of the top and bottom walls 13, 14 are arranged in another row behind the openings 134 and communicate with the respective second recess portion 132. Each of the top and bottom walls 13, 14 has a pair of projections 136 formed at the first recess portion 131 and each projection 136 defining an oblique surface extending backwardly. The projections 136 are located on back sides of the contact grooves 135. Each of the two side walls 15 defines a hole 151 passing therethrough and communicating with the receiving chamber 12, and two inclined portions 152 formed at two sides of the hole 151 in a front-to-back direction.

The base portion 11 has a pair of upper and lower cavities 111, 112 recessed forwardly from a rear face thereof, and a partition board 113 separating the upper and lower cavities 111, 112 from each other, two rows of interval partition walls 114 located between the receiving chamber 120 and the respective upper and lower cavities 111, 112 to form two rows of passageways 115 connecting the receiving chamber 120 and the respective upper and lower cavities 111, 112. Each of the top and bottom walls 13, 14 has a pair of through holes 138 passing therethrough and communicating with the respective upper and lower cavities 111, 112.

The metal sheet 20 substantially presents as a tabular shape and includes a front part 21 insert-molded into the partition board 113 of the insulative housing 10 and a rear part 22 protruding beyond the insulative housing 10 rearwardly. The rear part 22 has a pair of spring tabs 23 formed at two sides thereof and a cutout 24 recessed forwardly from a rear end thereof.

The contact modules 30 include a pair of upper and lower contact modules 31, 32 assembled together. Each contact module 30 includes a plurality of contacts 34 which are deflectable along a first direction vertical to an insertion of a mating USB Type-C receptacle connector and an insulator 33 insert-molded with the contacts 34. The insulator 33 defines three sections presented as a stepped shape and including a front section 331, a middle section 332, and a rear section 333. A pair of resisting arms 334 extend backwardly from the rear section 333, each resisting arm 334 has a L-shaped receiving groove 336 passing through an outside thereof and facing toward the inner circuit board 50.

The contacts 34 includes a first set of contacts in an upper row and a second set of contacts in a lower row each of which is aligned with corresponding contacts in the first set of contacts along the first direction. Each of the contacts 34 includes a retaining portion (not shown) insert-molded into the insulator 33, an arc resilient contact portion 341 extending forwardly from the retaining portion and protruding beyond the front section 331, and a tail portion 342 extending backwardly from retaining portion and protruding beyond the rear section 333. The contacting portions 341 of each contact module 30 are arranged in one row along the transverse direction and are deflectable along the first direction vertical. The tail portions 342 of each contact module 30 are arranged in one row along the transverse direction and located between the respective two resisting arms 334. The contacts 34 of the upper and lower contact modules 31, 32 have the same amounts and align with each other in a height direction. The electrical functions of the contacts 34 of the upper module 31 and the lower contact module 32 are arranged in a reverse order so that the electrical connector 100 can be plugged with the complementary connector in either way.

When the upper and lower contact modules 31, 32 are assembled to the insulative housing 1, the front sections 331 of the insulators 33 are inserted into the upper and lower cavities 111, 112 respectively, the middle sections 332 rearwardly protruding beyond the insulative housing 10. The contacting portions 341 pass through the respective passageways 115 and protrude into the receiving chamber 120, the contacting portions 341 are partly received in the contact grooves 135. The rear part 22 of the metal sheet 20 is sandwiched between the insulators 33 of the two contact modules 30, therefore, the metal sheet 20 is located between the contacts 34 of the upper and lower contact modules 31, 32 so as to decrease interference between the contacts 34 of the two contact modules 31, 32. The spring tabs 23 protrude outwardly beyond contact modules 30 and contact with the inner metal shell 60 so as to realize ground connection.

The two mylar foils 40 are received in the second recess portions 132 and cover the contact grooves 135 to restrict movement of the contact portions 341 of the contacts 34.

The inner circuit board 50 defines a front part sandwiched between the resisting arms 334 of the two insulators 33 and having a set of golden fingers (not shown) formed at upper and lower surfaces thereof for soldering with the tail portions 342 of the contacts 34, a rear part for connecting to the cables, and a protruding part 51 protruding forwardly from the front part. The protruding part 51 enters the cutout 24 of the metal sheet 20 and is sandwiched between the two insulators 33. Each insulator 33 has a notch 35 for receiving the protruding part 51. The inner circuit board 50 covers lower sides of the receiving grooves 336.

The inner metal shell 60 is formed by a piece of metal sheet so as to enhance structural strength. The inner metal shell 60 includes an oval tubular main frame 61, a pair of shielding slices 62 extending forwardly from upper and lower sides thereof, and a pair of clips 63 extending forwardly from two lateral sides thereof and separated from the shielding slices 62. Both the main frame 61 and the shielding slices 62 have a set of latching holes 611, 621 and a set of resilient beams 612, 622. Each shielding slices 62 has three spring arms 623 extending forwardly therefrom. Each spring arm 623 comprises a spring finger 624, and a contacting arm 625 punched therefrom and forming a punching hole 626 behind the spring finger 624. The contacting arm 625 locates behind the respective spring finger 624 and protruding outwardly beyond the respective spring finger 624. One end of the contacting arm 625 connects a front edge of the punching hole 626, and the other end of the contacting arm 625 protrudes outwardly beyond the respective spring finger 624 to contact with the outer metal shell 40. Each clip 63 has a spring finger 631 protruding inwardly.

The main frame 61 completely surrounds the base portion 11 of the insulative housing 10 and middle sections 332 of the insulators 33. Each middle section 332 has a pair of protrusions 335 locking into the latching holes 611. The rear sections 333 protrude rearwardly beyond the main frame 61 and resist the main frame 61 forwardly to restrict back movement of the main frame 61. The spring tabs 23 of the metal sheet contact with the main frame 61 so as to realize ground connection.

The shielding slices 62 are received in the respective first recess portions 132 of the insulative housing 10 and cover the respective mylar foils 40. The mylar foils 40 locate between the insulative housing 10 and the shielding slices 62 so as to prevent the contact portions 341 of the contacts 34 from electrically contacting with the shielding slices 62. The projections 136 of the insulative housing 10 latch into the latching holes 621 of the shielding slices 62. The spring fingers 624 pass through the respective openings 134 and protrude into the receiving chamber 120 for contacting with the complementary connector. The spring fingers 631 of the clips 63 pass through the respective holes 151 and protrude into the receiving chamber 120 for contacting with the complementary connector. Free ends of the spring fingers 631 of the clips 63 resist on the respective inclined portions 152 formed at front sides of the holes 151 so as to prevent the spring fingers 631 from excess movement. Therefore, the inner metal shell 60 of the present invention could be assembled to the insulative housing 10 easily, the insulative housing 10 and contact modules 30 could be combined with each other reliably via the inner metal shell 60 so as to enhance the structural strength of the electrical connector 100.

The outer metal shell 70 presents as an oval tubular shape and includes a pair of top and bottom plates 71, 72, and a pair of side plates 73 connecting the top and bottom plates 71, 72. The outer metal shell 70 completely surrounds the inner metal shell 60 and the rear sections 333 of the contact modules 30. The outer metal shell 70 is located at back of the annular rib 101 and defines a front end forwardly resisting on the annular rib 101. The resilient beams 612, 622 and the contacting arms 625 of the inner metal shell contact with the outer metal shell 70. The outer metal shell 70 has four legs 74 formed at rear ends of connections of the side plates 73 and top and bottom plates 71, 72. Each leg 74 covers the respective resisting arm 334, and defines a connecting pad 75 bending inwardly therefrom and received in the receiving groove 336 for connecting to the golden finger of the inner circuit board 50 so as to realize ground connection.

The electrical connector 100 of the present invention defines the inner and outer metal shells 60, 70 to provide a double layer metal structure for double shielding the electrical connector 100 so as to satisfy strict requirement of anti-EMI and improve performance of transmitting high-frequency signals. Meanwhile, the one piece inner metal shell 60 could enhance the structural strength of the electrical connector 100, and the service life of the electrical connector 100 could be extended effectively.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector, comprising:

an insulative housing defining a top wall, a bottom wall, a pair of side walls connecting the top and bottom walls, and a receiving chamber surrounded by the top wall, the bottom wall and the two side walls, each of the top and bottom walls defining a first recess portion and a set of openings disposed at front of the first recess portion, each of the side walls defining a hole;

at least one contact module assembled to the insulative housing, the contact module including an insulator and a plurality of contacts retained in the insulator, each contact defining a contact portion protruding into the receiving chamber;

an one-piece inner metal shell defining a main frame surrounding the insulative housing by 360 degrees, the inner metal shell comprising a pair of shielding slices extending forwardly from upper and lower sides thereof, and a pair of clips extending forwardly from two lateral sides thereof and separated from the shielding slices, each shielding slice being received in the respective first recess portion and defining a set of spring fingers passing through the respective openings and protruding into the receiving chamber, each clip resisting on an outer surface of the respective side wall and having a spring finger passing through the respective hole and protruding into the receiving chamber; and a tubular outer metal shell surrounding the inner metal shell and contacting with the inner metal shell.

2. The electrical connector as claimed in claim 1, wherein the insulative housing comprises a base portion and a mating portion extending forwardly from the base portion, the receiving chamber is formed on the mating portion, the main frame surrounding the base portion of the insulative housing, the contact portion is deflectable along a first direction vertical to an insertion of a mating universal serial bus (USB) Type-C receptacle connector, the contacts includes a first set of contacts in an upper row and a second set of contacts in a lower row each of which is aligned with corresponding contacts in the first set of contacts along the first direction.

3. The electrical connector as claimed in claim 1, wherein each of the shielding slices has a set of spring arms extending forwardly therefrom, the spring fingers are formed at front ends of the respective spring arms; each spring arm has a contacting arm located behind the respective spring finger, and a punching hole formed after said contacting arm being punched from the spring arm; one end of the contacting arm connects a front edge of the punching hole, and the other end of the contacting arm protrudes outwardly beyond the respective spring finger to contact with the outer metal shell.

4. The electrical connector as claimed in claim 1, wherein each of the top and bottom walls defines a second recess portion recessed from the respective first recess portion toward the receiving chamber, and a set of contact grooves communicating with the second recess portion for receiving the contact portions; the electrical connector further comprises a pair of mylar foils received in the respective second recess portions to prevent the contact portions of the contacts from electrically contacting with the shielding slices.

5. The electrical connector as claimed in claim 2, wherein said at least one contact module includes a pair of upper and lower contact modules assembled together, each contact module includes said insulator and the plurality of contacts retained in the insulator; each of the contacts includes said contact portion extending forwardly beyond the insulator and a tail portion extending rearwardly beyond the insulator; the base portion has a pair of upper and lower cavities recessed forwardly from a rear face thereof, and a partition board separating the upper and lower cavities from each other; the upper and lower contact modules are forwardly inserted into the respective upper and lower cavities of the insulative housing.

6. The electrical connector as claimed in claim 5, wherein each insulator defines three sections presented as a stepped shape and including a front section, a middle section, and a rear section; the front sections are inserted into the respective upper and lower cavities, the middle sections protrude rearwardly beyond the insulative housing and are surrounded by the main frame, the rear sections protrude rearwardly beyond the main frame and forwardly resist on the main frame.

7. The electrical connector as claimed in claim 5, wherein the electrical connector further comprises a metal sheet disposed between the upper and lower contact modules; the metal sheet includes a front part insert-molded into the insulative housing, and a rear part rearwardly protruding beyond the insulative housing and being sandwiched between the insulators; the rear part has a pair of spring tabs formed at two sides thereof and contacting with the inner metal shell.

8. The electrical connector as claimed in claim 5, wherein the electrical connector further comprises a set of cables, and an inner circuit board connecting the contacts and the cables; the inner circuit board defines a plurality of golden fingers for soldering the tail portions of the contacts; each contact module has a pair of resisting arms extending rearwardly from a rear end thereof, the inner circuit board is sandwiched between the resisting arms of the two insulators.

9. The electrical connector as claimed in claim 8, wherein each resisting arm has a L-shaped receiving groove passing through an outside thereof and facing toward the inner circuit board; the outer metal shell includes a pair of top and bottom plates, and a pair of side plates connecting the top and bottom plates; the outer metal shell has a set of legs formed at rear ends of connections of the side plates and top and bottom plates; each leg covers the respective resisting arm, and defines a connecting pad bending inwardly therefrom and received in the receiving groove for connecting to the golden finger of the inner circuit board.

10. An electrical connector, comprising:

an insulative housing defining a receiving chamber recessed rearwardly from a front side thereof, an annular rib surrounding the receiving chamber at an entrance of the receiving chamber, and a plurality of openings formed on the insulative housing and connecting the receiving chamber with exterior, the openings being located at back of the annular rib;

a plurality of contacts extending into the receiving chamber;

an inner metal shell retained in the insulative housing, and defining a plurality of spring fingers passing through the respective openings and protruding inwardly into the receiving chamber; and an outer metal shell surrounding the insulative housing; wherein the outer metal shell locates at back of the annular rib and contacts with the inner metal shell.

11. The electrical connector as claimed in claim 10, wherein the outer metal shell defines a front end forwardly resisting on the annular rib, each of the contacts defines a resilient contact portion protruding inwardly into the receiving chamber and locating at a rear position apart away from the spring fingers, the resilient contact portion is deflectable along a first direction vertical to an insertion of a mating universal serial bus (USB) Type-C receptacle connector, the contacts includes a first set of contacts in an upper row and a second set of contacts in a lower row each of which is aligned with corresponding contacts in the first set of contacts along the first direction.

12. The electrical connector as claimed in claim 10, wherein the inner metal shell defines at least one contacting arm locating at a position corresponding one of the spring fingers and protruding outwardly opposite to the corresponding spring finger to contact with the outer metal shell.

13. The electrical connector as claimed in claim 10, wherein the contacting arm defines a front end locating behind a front end of the corresponding spring finger.

14. An electrical connector, comprising:

an insulative housing defining a top wall, a bottom wall, a pair of side walls connecting the top and bottom walls, and a receiving chamber surrounded by the top wall, the bottom wall and the two side walls and passing through a front end thereof;

a pair of contact modules assembled to the insulative housing, each of the contact modules including an insulator and a plurality of contacts retained in the insulator, each contact defining a contact portion protruding into the receiving chamber, each insulator comprising a front section inserted into the insulative housing, a middle section and a rear section protruding beyond the insulative housing;

an inner metal shell defining a main frame surrounding both the insulative housing and the middle sections of the insulators, the rear sections of the insulators protruding beyond the main frame; and a tubular outer metal shell surrounding both the inner metal shell and the rear sections of the insulators, the outer metal shell contacting with the inner metal shell.

15. The electrical connector as claimed in claim 14, wherein the front, middle and rear sections of each of the insulators are presented as three-stepped ladder; the insulative housing has a pair of cavities recessed forwardly from a rear end thereof and a partition board separating the two cavities from each other; the front sections of the contact modules are forwardly inserted into the respective cavities of the insulative housing, the rear sections of the insulators forwardly resist on the main frame.

16. The electrical connector as claimed in claim 14, wherein each of the top and bottom walls defines a first recess portion and a set of openings disposed at front of the first recess portion, each side wall defines a hole; the inner metal shell comprises a pair of shielding slices extending forwardly from upper and lower sides thereof, and a pair of clips extending forwardly from two lateral sides thereof and separated from the shielding slices; each shielding slice is received in the respective first recess portion, and defines a set of spring fingers passing through the respective openings and protruding into the receiving chamber; each clip resists on an outer surface of the respective side wall, and defines a spring finger passing through the respective hole and protruding into the receiving chamber.

17. The electrical connector as claimed in claim 16, wherein the insulative housing defines an annular rib surrounding the top, bottom, and two side walls at front thereof; both the openings and the holes locate at back of the annular rib, the outer metal shell locates behind and forwardly resist on the annular rib, the contact portion is deflectable along a first direction vertical to an insertion of a mating USB Type-C receptacle connector, the contacts includes a first set of contacts in an upper row and a second set of contacts in a lower row each of which is aligned with corresponding contacts in the first set of contacts along the first direction.

18. The electrical connector as claimed in claim 14, wherein the electrical connector further comprises a metal sheet disposed between the two contact modules; the metal sheet includes a front part insert-molded into the insulative housing, and a rear part protruding beyond the insulative housing and being sandwiched between the insulators; the rear part has a pair of spring tabs formed at two sides thereof and contacting with the inner metal shell.

19. The electrical connector as claimed in claim 14, wherein the electrical connector further comprises an inner circuit board defining a plurality of golden fingers for electrically connecting the contacts; each contact module has a pair of resisting arms extending rearwardly from a rear end of the rear section, the inner circuit board is sandwiched between the resisting arms of the two insulators; each resisting arm has a receiving groove passing through an outside thereof and facing toward the inner circuit board; the outer metal shell includes a set of legs extending therefrom; each leg covers the respective resisting arm, and defines a connecting pad bending inwardly therefrom and received in the receiving groove for connecting to the golden finger of the inner circuit board.

* * * * *